United States Patent [19]

Russell

[11] 4,022,261

[45] May 10, 1977

[54] HANDBAG WITH DISPLAY POCKETS

[76] Inventor: Dorothy Burnham Russell, 802 Elmwood Drive, Escondido, Calif. 92025

[22] Filed: Aug. 24, 1976

[21] Appl. No.: 717,156

[52] U.S. Cl. ..... 150/28 A; 150/28 R; 150/30

[51] Int. Cl.[2] ..... A45C 3/06

[58] Field of Search ..... 150/28 R, 28 A, 30, 150/34

[56] References Cited

UNITED STATES PATENTS

| | | | |
|---|---|---|---|
| 2,522,549 | 9/1950 | Waggoner | 150/28 R |
| 3,536,116 | 10/1970 | Margolis | 150/28 A |
| 3,550,663 | 12/1970 | Johnston | 150/28 A |
| 3,744,541 | 7/1973 | Brauhut | 150/28 R |

FOREIGN PATENTS OR APPLICATIONS

| | | | |
|---|---|---|---|
| 111,393 | 7/1964 | Czechoslovakia | 150/28 A |
| 1,131,228 | 9/1955 | France | 150/28 R |

*Primary Examiner*—Ro E. Hart
*Attorney, Agent, or Firm*—Brown & Martin

[57] ABSTRACT

A handbag having generally rectangular front and back panels is constructed of a double wall of pliable sheet material with the outer wall being transparent, the walls secured together along spaced apart vertical and horizontal intersecting seams for defining a plurality of picture receiving pockets. The pockets are provided with a horizontal slit in the upper edge of the inner wall at the upper edge of each pocket and an inner lining is detachably secured along its upper edge to the inside of the handbag for covering the pockets for retaining the pockets closed and the photographs in the respective pockets.

12 Claims, 3 Drawing Figures

HANDBAG WITH DISPLAY POCKETS

BACKGROUND OF THE INVENTION

The present invention relates to handbags and pertains particularly to a photo display handbag.

Photographs are frequently carried in handbags or purses in order to be handy for showing to others when the opportunity arises. Such photographs are frequently carried in wallets and envelopes along with other articles in the handbag. It is therefore frequently necessary to dig through the articles in the purse or handbag in order to find the photographs.

SUMMARY AND OBJECTS OF THE INVENTION

It is the primary object of the present invention to overcome the above problem of the prior art.

Another object of the present invention is to provide a handbag having means to conveniently display photographs.

A further object of the present invention is to provide an improved handbag having a plurality of photograph receiving pockets with a transparent outer covering so that the photographs are readily displayed to be visible through the outer surface of the handbag.

In accordance with the primary aspect of the present invention, a handbag is constructed of an outer transparent cover with internal pockets for receiving a plurality of photographs for display through the outer cover and an inner lining to be secured in place for retaining the photographs in the respective pockets.

BRIEF DESCRIPTION OF THE DRAWINGS

The above and other objects and advantages of the present invention will become apparent from the following description when read in conjunction with the accompanying drawings wherein.

DETAIL DESCRIPTION OF THE PREFERRED EMBODIMENT

Figure 1:
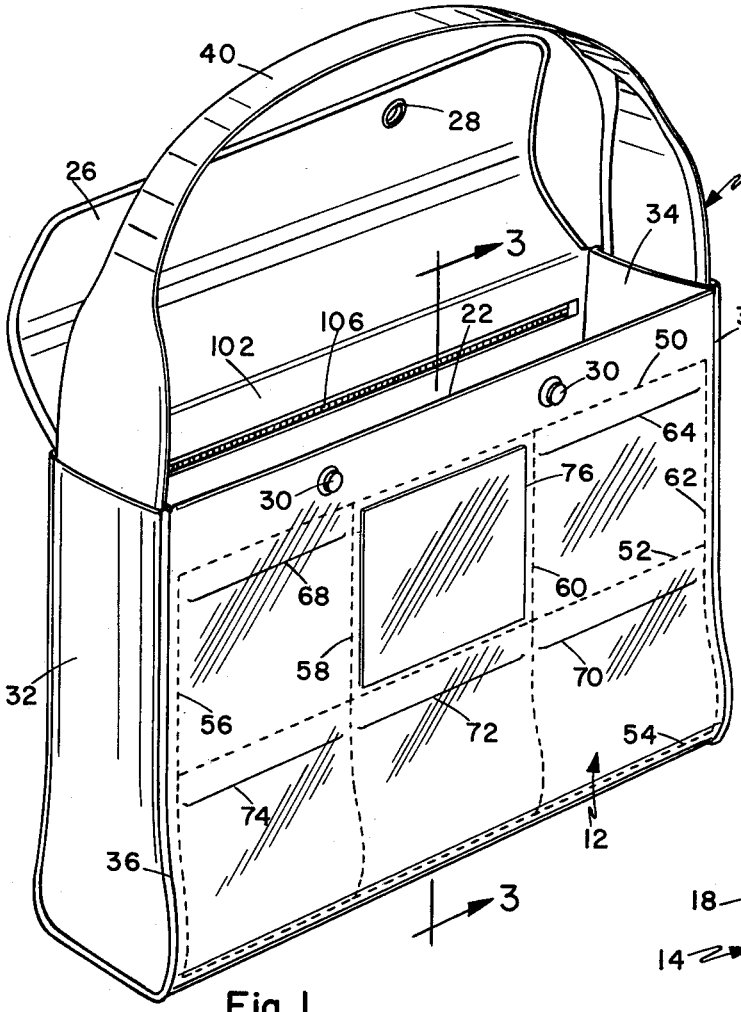
FIG. 1 is a perspective view of the handbag from the front with the top flap open.

Turning now to the drawing and first to FIG. 1, there is illustrated a handbag in accordance with the present invention indicated generally by the numeral 10. The handbag, for illustrative purposes, is of substantially conventional design having a cover shaped to define a pocket or cavity with a closure flap and a carrying strap. The carrying strap may be of the hand or shoulder type, as desired.

Figure 3:
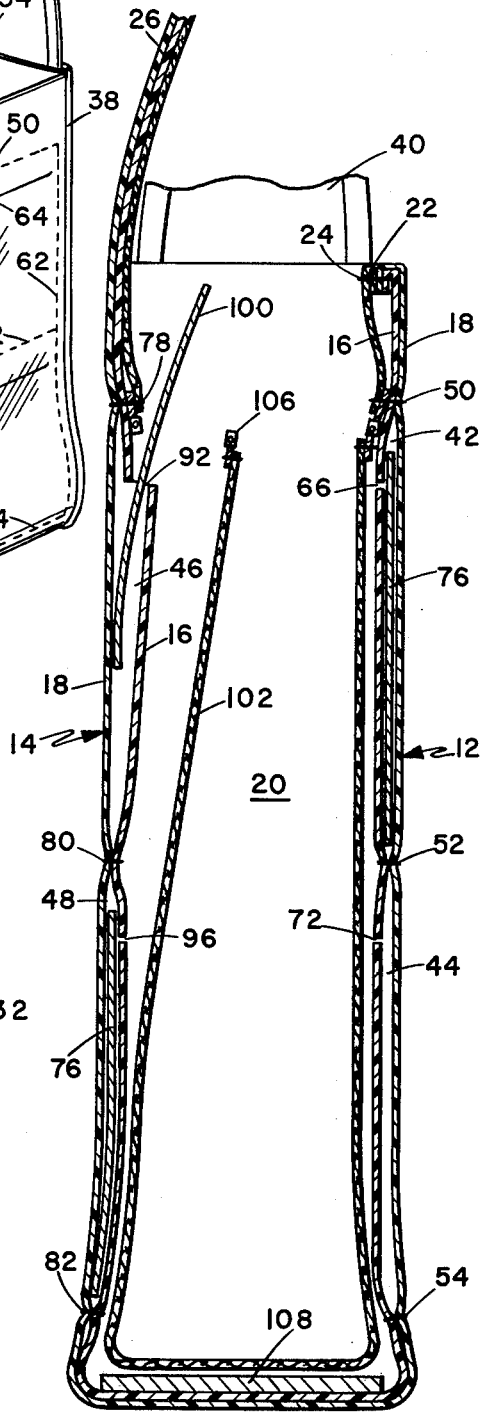
FIG. 3 is an enlarged sectional view taken along line 3—3 of FIG. 1 and showing insertion of a photograph in a pocket.

As best seen in FIG. 3, the body of the purse or handbag is constructed of front and back panels indicated generally by the numerals 12 and 14 respectively. In the illustrated embodiment, the front and back panels are both constructed of inner and outer sheets 16 and 18 of pliable material of a generally rectangular configuration. The outer sheet 18 is of a transparent material of a suitable pliable nature. The sheets are secured together in a double layer fashion as shown in FIG. 3 and folded in a U-shaped cross sectional configuration to define the inner pocket or cavity 20 of the purse.

These sheets 16 and 18 terminate at an edge 22 defining the upper edge of the front panel and are secured together in a suitable fashion such as sewing along a seam 24. The other end of these sheets extend upward beyond the back panel 14 for defining a flap or closure cover 26. Suitable snap fastener means or members 28 and 30 are secured respectively to the flap and the upper forward edge of the front panel 12 for securing the flap or closure in the closed position. A pair of end or side panels 32 and 34 are secured in a suitable manner such as by sewing along seams 36 and 38 to the edges of front and rear panels 12 and 14 for completing the pocket or cavity of the purse. A carrying strap 40 of a suitable length is secured at opposite ends to the respective side or end panels 32 and 34.

A plurality of photograph receiving pockets, such as 42, 44, 46 and 48, illustrated in FIG. 3, are formed between the inner and outer sheets 16 and 18 in the front and rear panels 12 and 14. These pockets are formed in the front panel for example, by a plurality of parallel, horizontal seams 50, 52 and 54 securing the inner and outer sheets 16 and 18 together along the spaced seams. A plurality of spaced apart vertically extending parallel seams 56, 58, 60 and 62 likewise secure the sheets 16 and 18 together along vertical lines to further divide the panels into the respective pockets.

Openings into the respective pockets are defined by a plurality of horizontal slits as shown in FIG. 1, for example, extending along the upper edges of the respective pockets. These slits, identified by reference numerals 64, 66, 68, 70, 72 and 74, define the respective separate pockets in the front panel.

As seen in FIG. 3, the slit 66 runs parallel to the upper seam 50 between vertical seams 58 and 60 and defines an opening into the pocket defined by the inner and outer sheets 16 and 18. This pocket contains a photograph designated by the reference numeral 76. The slot 66 is formed in the inner sheet 16 so that the opening of the pocket is inside the purse. The photograph is inserted into the pocket such that the face is facing outward and exposed through the transparent sheet 18. Thus, the photographs are visible from the outside of the purse.

Figure 2:
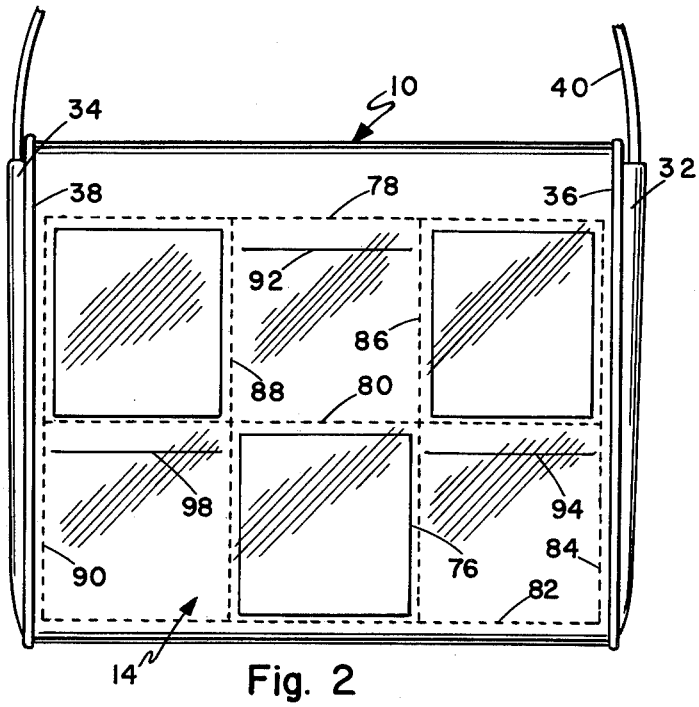
FIG. 2 is a rear elevational view of the handbag with the top flap closed.

Turning now to FIG. 2, it will be seen that the back panel in the illustrated embodiment is likewise constructed to have a plurality of pockets, these pockets being defined by a plurality of horizontal seams 78 through 82 and a plurality of parallel vertical seams 84 through 90. As in the above description regarding the front panel, the pockets are provided with openings defined by slits 92 for pocket 46 and numerals 94 through 98 for the remaining slits which are illustrated.

As best seen in FIG. 3, the photograph 100 is being inserted into the pocket 46 through opening defined by the slit 92. As also illustrated therein, the inside of the pockets and likewise the opening into the pockets are covered by inner lining 102 of the purse. This inner lining 102 covers the entire inner surface of sheet 16 and particularly the front and back panels. The lining 102 is connected by suitable detachable securing means, such as a zipper 104 to the front panel for covering the front pockets and by a zipper 106 to the rear panel for covering the pockets in the rear panel.

The insertion or removal of a photograph is accomplished simply by unzipping either one of the zippers 104 and 106 and as illustrated in FIG. 3, pulling the inner lining 102 away from the back panel as illustrated, opening the slot 92 and either removing or inserting a photograph 100. It will also be appreciated, from the view of FIG. 3 especially, that the slits defining the opening into the respective pockets are located at a position to be slightly below the upper edge of the photograph when in place. The photographs are assumed to be standard size and the pockets constructed accordingly, such that the upper edge of the photograph as illustrated, for example, with regard to the photographs located in pockets 42 and 48 in FIG. 3 extends upward beyond the slits 66 and 96. With this arrangement, the upper edge of the photograph bears against the portion of the inner lining above the slits 66 and 96 to thereby retain the photograph more firmly in its position.

The remaining internal portion of the purse or pocketbook including the flap 26 is covered by a lining as desired. Likewise a stiffener 108 is included in the bottom of the purse as illustrated in FIG. 3 and may be secured into position as defined by any suitable means to the inner sheet 16. It may also be appreciated that the purse may be constructed to have the photo pocket on one or both of the front and back panels and likewise on the side panels.

While the present invention has been illustrated and described by means of a single embodiment, it is to be understood that numerous changes and modifications may be made therein without departing from the spirit and scope of the invention, as defined in the appended claims.

Having described my invention, I now claim:

1. A picture display handbag comprising:

front and back pliable panels secured together for defining a cavity for containing a plurality of articles, at least one of said front and back panels comprising inner and outer sheets of pliable material secured together along a plurality of intersecting vertical and horizontal lines defining a plurality of pockets, said outer sheet of pliable material being transparent, said inner sheet having a slit extending across each pocket adjacent to and parallel to the upper edge thereof for defining an opening into each of said pockets, and an inner lining shaped to conform generally to said cavity for covering said inner sheet and detachably secured to said inner sheet along a line parallel to and adjacent the upper edge thereof.

2. The handbag of claim 1 wherein:

said one of said panels is substantially rectangular in configuration.

3. The handbag in accordance with claim 1 wherein:

both of said front and back panels comprises inner and outer sheets of pliable material secured together for defining said plurality of pockets and the outer sheet of each of said panels being transparent.

4. A handbag in accordance with claim 1 wherein:

said plurality of pockets are substantially rectangular in configuration and said one of said front and back panels including a plurality of vertical and horizontal rows of said pockets.

5. A handbag in accordance with claim 1 wherein:

said front and back panels are substantially rectangular in configuration and are formed of a pair of continuous sheets substantially rectangular in configuration, said sheets terminating at an upper edge on said front panel and extending to form a flap extending upward from the back panel.

6. The handbag in accordance with claim 5 comprising:

a pair of rectangular end panels secured along the edges thereof to the edges of said front and back panels for defining said cavity.

7. The handbag in accordance with claim 5 wherein:

said entire outer sheet of pliable material is transparent and both of said front and back panels are secured together along a plurality of intersecting vertical and horizontal lines defining a plurality of said pockets.

8. The handbag in accordance with claim 7 wherein:

each of said front and back panels include a plurality of rows of said pockets.

9. The handbag in accordance with claim 8 wheren:

said pockets are generally rectangular in configuration.

10. The handbag in accordance with claim 8 wherein:

said pockets are generally square in configuration.

11. The handbag in accordance with claim 1, wherein:

said inner liner is secured along the upper edge thereof to said inner sheet by zipper means.

12. The handbag in accordance with claim 7 wherein:

said inner lining is shaped to cover the inner sheet of both said front and back panels and is secured at its upper edge by zipper means.

* * * * *